US005511816A

United States Patent [19]

Sedlmair

[11] Patent Number: 5,511,816

[45] Date of Patent: Apr. 30, 1996

[54] BASE PLATE AND MOVABLE ANTI-FRICTION DEVICE OF A SKI BINDING

[75] Inventor: Gerhard Sedlmair, Farchant, Germany

[73] Assignee: Marker Deutschland GmbH, Germany

[21] Appl. No.: 371,956

[22] Filed: Jan. 12, 1995

[51] Int. Cl.[6] ..... A63C 9/00

[52] U.S. Cl. ..... 280/636

[58] Field of Search ..... 280/607, 618, 280/633, 636

[56] References Cited

U.S. PATENT DOCUMENTS

| | | | |
|---|---|---|---|
| 3,544,123 | 12/1970 | Werner et al. | 280/636 |
| 4,088,345 | 5/1978 | Korger | 280/636 |
| 4,169,612 | 10/1979 | Kirsch | 280/611 |
| 4,561,673 | 12/1985 | Pascal et al. | 280/636 X |
| 5,040,822 | 8/1991 | Gallet et al. | 280/636 |
| 5,114,174 | 5/1992 | Bogner | 280/636 |

FOREIGN PATENT DOCUMENTS

| | | |
|---|---|---|
| 2473328 | 3/1983 | France . |
| 2652273A2 | 3/1991 | France . |
| 2652508A1 | 4/1991 | France . |
| 2716431A1 | 10/1978 | Germany . |
| 3918922A1 | 12/1990 | Germany . |

*Primary Examiner*—Margaret A. Focarino
*Assistant Examiner*—Michael Mar
*Attorney, Agent, or Firm*—D. Peter Hochberg; Mark Kusner; Michael Jaffe

[57] ABSTRACT

A ski binding including a rocking anti-friction device for cooperating with a base plate to maintain the level of friction between the ski boot sole and the sole holder, as the ski boot is laterally released from the ski binding.

10 Claims, 3 Drawing Sheets

BASE PLATE AND MOVABLE ANTI-FRICTION DEVICE OF A SKI BINDING

FIELD OF THE INVENTION

The present invention relates generally to a ski binding base plate having a cooperating anti-friction device ("AFD") positioned therein, and more particularly to a ski binding base plate having an AFD which is rocked as a ski boot moves over the AFD to generally keep the friction occurring on the ski constant as the boot is released from the binding.

BACKGROUND OF THE INVENTION

There are several ski bindings known in the prior art which keep the friction relatively constant on the ski as the ski boot is released laterally from the ski binding. In this respect, German patent publication 25 49 203 A discloses a slide plate that rests displaceably on a support plate, there being provided only a line contact between the slide plate and the support plate by means of ribs. The slide plate is held on the support plate by a rubber band.

German patent publication 39 18 922 A discloses a base plate of the generic type in which a transversely movable footboard is provided. The movable footboard can be freely rolled off in a lateral direction on a rolling plate fixed to the ski surface, the rolling plate having supporting rollers arranged side-by-side.

Prior art designs of anti-friction devices have always incorporated a sliding member that is transversely displaceable with respect to the base plate on which the ski boot rests. Among the drawbacks to the prior art designs is that the movement of the transversely displaceable support member may be impaired by ice or dirt. Another drawback of the prior art is that they have a comparatively complex structure. The present invention overcomes these and other shortcomings of prior art devices.

SUMMARY OF THE INVENTION

According to the present invention there is provided a cooperating anti-friction device and a base plate. The anti-friction device is comprised of a rocking member pivotally supported by cooperating parts of a ski binding base plate. The AFD has at least one, and preferably two protrusions or elevations extending above the base plate surface in a no-load condition. When a ski boot is introduced into the ski binding, the sole of the ski boot rests uniformly on both protrusions extending above the surface of the base plate. When forces occur during skiing which displace the ski boot transversely with respect to the base plate, and could possibly lead to the release thereof by means of the opening of the lateral-holding parts of the ski binding sole holder front jaw, a shifting of the contact pressure force exerted by the ski boot sole occurs. Consequently, the protrusion to which a higher force is applied by the boot sole is pressed into the base plate. This arrangement results in a reduction of the friction between the ski boot sole and the ski binding front jaw or sole holder, during lateral release of the ski boot from the ski binding.

According to another aspect of the present invention, there is provided a rocking member comprised of a central portion and two laterally disposed end portions having respective protrusions extending above the upper surface of the base plate. The central portion includes a pair of aligned, longitudinally extending rods or pins for connecting laterally extending support arms thereto, the support arms being parallel to the central portion. It should be appreciated that the "longitudinal" direction refers to the longitudinal direction of the base plate or ski, and that the "transverse" direction refers to a direction which crosses the longitudinal axis of the base plate or ski. The rods or pins are received in respective slots or recesses provided in the lower surface of the base plate. The support arms are bevelled from the pins towards their respective ends. The bevelled surfaces of the support arms converge in the region of the pins and form a single tilting edge along which the rocking member may respectively tilt laterally.

According to another aspect of the present invention there is provided a base plate having bearing surfaces or areas which cooperate respectively with the bevelled support arms such that a defined pivoting movement of the rocking member is carried out when a higher load is applied to one of the protrusions extending above the base plate surface, than to the other protrusion.

According to another embodiment of the present invention there is provided at least one support arm having a flat bearing surface at the center thereof and having a bevelled surface adjacent thereto, extending from the flat bearing surface to the respective end(s) of the support arm(s). Accordingly, two tilting edges are formed, respectively, along the contact lines between the flat bearing surface and the adjacent bevelled surfaces. Bearing surfaces or areas, which are optionally provided in the base plate, respectively cooperate with the end region of the bevelled support arms. In this respect, a defined pivoting movement of the rocking member is carried out when one of the protrusions extending above the base plate surface is subject to a higher load than the other protrusion, as a ski boot is laterally displaced. Accordingly, in this embodiment of the present invention, the ski boot must first be laterally displaced by a predetermined amount before the rocking member will pivot.

According to a further embodiment of the present invention there is provided a rocking member having only one support arm such that an additional degree of freedom of movement is allowed in the longitudinal direction of the base plate.

One object of the present invention is to provide an anti-friction device and a cooperating base plate that maintain relatively constant friction between the ski boot sole and front jaw or sole holder, when the ski boot is released laterally from the ski binding.

Another object of the present invention is to provide an anti-friction device which is not impaired by ice and dirt.

Still another object of the present invention is to provide an anti-friction device which has a relatively simple structure, inexpensive to produce, and effective and efficient in operation.

A more general object of the present invention is to provide rocking means or displacement means for reducing the frictional force between the ski boot sole and the sole holder means, the rocking means or displacement means rocking or pivoting downwardly on one side or the other of the base plate as the ski boot moves laterally of the base plate part of the invention with sufficient downward force. The rocking can occur through the configuration of the displacement means, such as tilted support means on which the boot sits, or through the configuration of the base plate (or even the ski) on which the displacement means is located, such as a protrusion on the base plate and a displacement member sitting laterally across the displacement member.

These and other objects will become apparent from the following description of preferred embodiments taken together with the accompanying drawings, and the appended claims.

BRIEF DESCRIPTION OF THE DRAWINGS

Further details and advantages of the invention will now be explained in detail by means of embodiments represented in the drawings, wherein.

DETAILED DESCRIPTION OF THE PREFERRED EMBODIMENT

Figure 1:
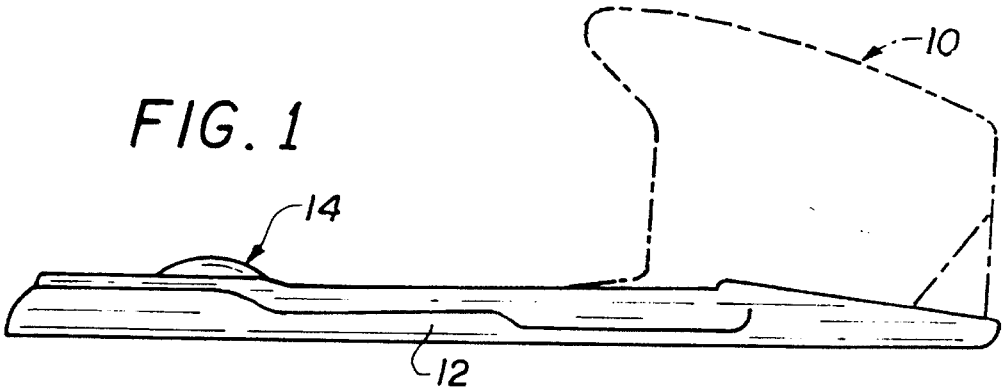
FIG. 1 is a side view of a toe piece with a base plate and a mounted rocking member, illustrating a first preferred embodiment of the present invention.

Referring to FIG. 1, there is shown a side view of a toe piece 10 of a ski binding. Toe piece 10 is generally comprised of a sole holder shown in phantom, a base plate 12 and a mounted rocking member 14. Although the preferred embodiment is described with respect to a base plate and a toe piece, it could be directed to a base plate with a heel support.

Rocking member or anti-friction device 14 is positioned within base plate 12. In particular, rocking member 14 is arranged in the longitudinal plane of symmetry of base plate 12. The structure of rocking member 14 is generally shown in FIGS. 4 through 8, in which a first preferred embodiment of rocking member 14 is shown.

Figure 5:
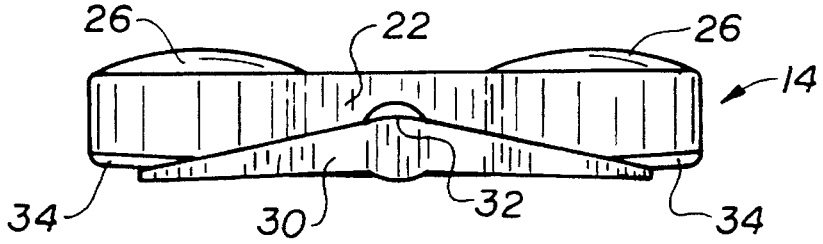
FIG. 5 is a side plan view of the rocking member according to the first preferred embodiment of the present invention.
Figure 6:
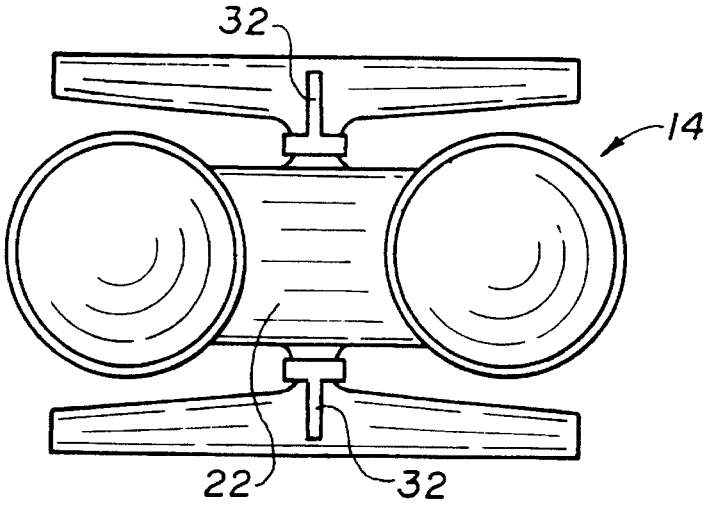
FIG. 6 is a top plan view of the rocking member according to the first preferred embodiment of the present invention.

Rocking member 14 is generally comprised of a central portion 22, two laterally located end portions 24, and laterally extending support arms 30. End portions 24 have a round shape in cross-section, and include protrusions 26, which are in the shape of spherical caps, as best shown in FIG. 5. Support arms 30 are mounted to central portion 22 via connecting pins or rods 28, which extend from central portion 22. Accordingly, support arms 30 extend transversely and parallel to central portion 22.

Figure 8:
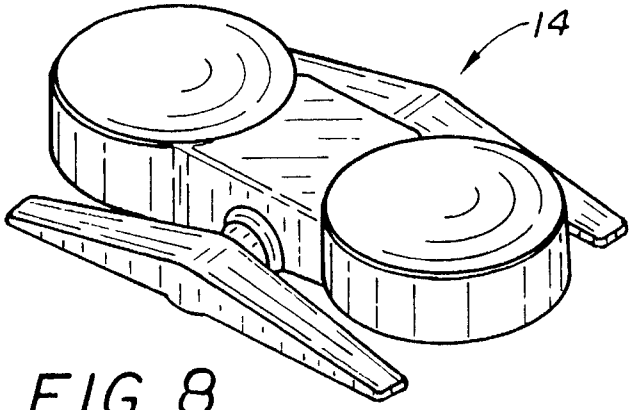
FIG. 8 is a top perspective view of the rocking member according to the first preferred embodiment of the present invention.

As best seen in the side view shown in FIG. 5 and in the perspective view shown in FIG. 8, support arms 30 have bevelled surfaces from the center thereof tilted downwardly to their respective ends. The bevelled surfaces converge in the area of rod 28 and form a single tilting edge 32, about which rocking member 14 tilts or pivots laterally. Thus, the thickness of arms 32 decreases towards the free ends thereof as shown in FIG. 5.

Figure 2:
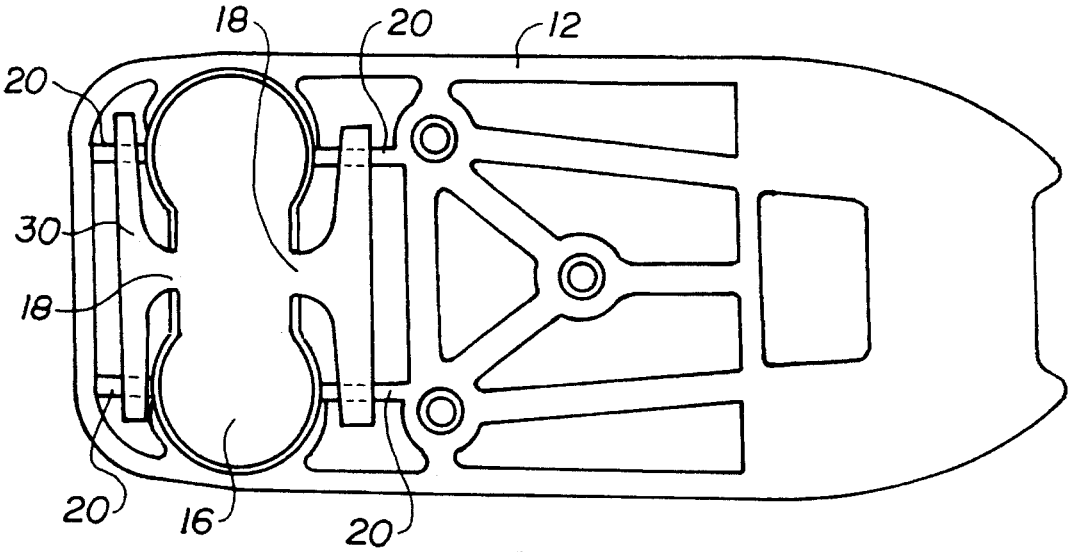
FIG. 2 is a bottom plan view of the base plate shown in FIG. 1.
Figure 3:
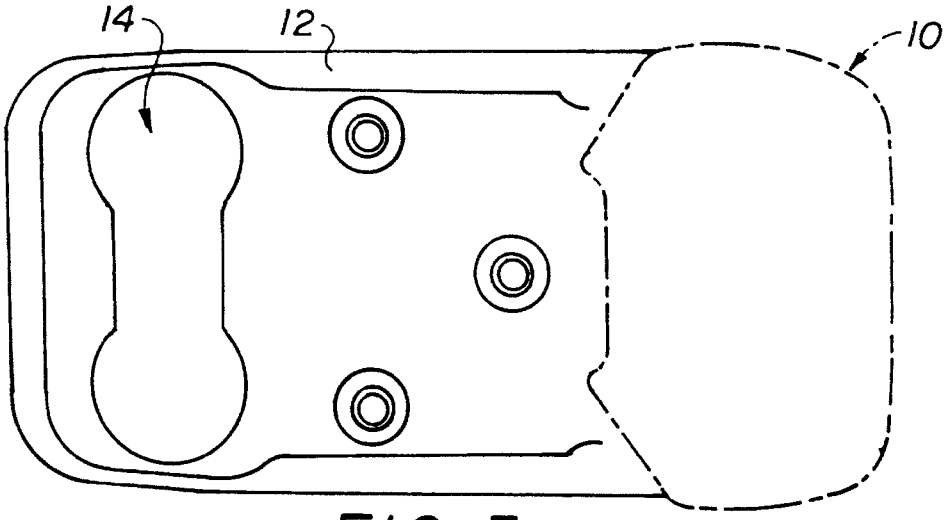
FIG. 3 is a top plan view of the base plate shown in FIG. 1.
Figure 4:
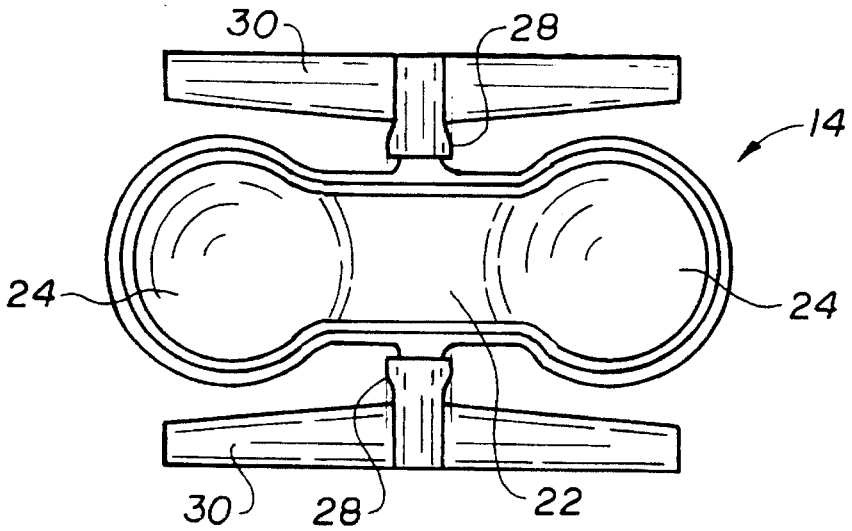
FIG. 4 is a bottom plan view of the rocking member according to the first preferred embodiment of the present invention.

Referring now to FIG. 2, rocking member 14 is provided in base plate 12 with rods 28 inserted into respective slots 18 formed in the lower surface of base plate 12. End portions 24 and central portion 22 are positioned within a recess in base plate 12. In a no-load condition, protrusions 26 extend above the upper surface of the base plate 12. Rocking member 14 may be pivoted about the respectively supported rods 28 until laterally mounted arms 30 abut against respective bearing surfaces in the form of contact bars 20, which are provided in base plate 12. Rocking member 14 pivots when the contact pressure force exerted by the ski boot shifts. The cooperation between arms 30 and contact bars 20 is coordinated so that when an arm 30 has pivoted such that it abuts against a contact bar 20, the protrusion 26 subject to the higher contact pressure force no longer extends above the upper surface of base plate 12.

It will be appreciated that rocking member 14 may be configured with only one support arm 30. In this case, the rocking member 14 has additional freedom of movement in the longitudinal direction of base plate 12. Accordingly, protrusions 26 can be pressed down during a lateral displacement of the ski boot, and also during a shifting of the ski boot contact pressure forces in the longitudinal direction of the ski. In order to assure the movability of rocking member 14, it can be additionally supported in a rubber-elastic bearing in the region of rods 28 positioned in slots 18.

As an alternative to the cooperation between the arms 30 of rocking member 14 and contact bars 20 of base plate 12, the end sections of support arms 30 may be supported on a flat surface (e.g., the surface of the ski). Accordingly, rocking member 14 can be swivelled against the material elasticity of support arms 30 which are comprised, for example, of injected synthetic material. In this alternative embodiment end portions 24 have lower bearing surfaces 34 that are bevelled upwards towards their outer ends so that a pivoting is possible with respect to a flat surface (see FIG. 5). Lower bearing surfaces 34 cooperate with the flat surface so that when one of the lower bearing surfaces 34 contacts with the flat surface, the protrusion 26 subjected to a higher contact pressure force will no longer protrude above the upper surface of base plate 12.

Figure 7:
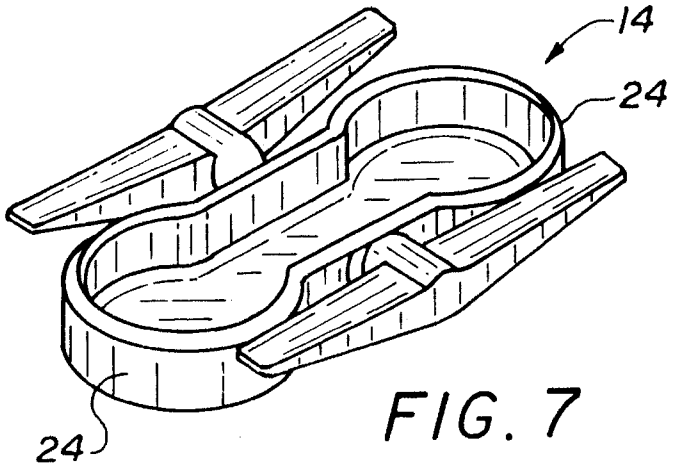
FIG. 7 is a bottom perspective view of the rocking member according to the first preferred embodiment of the present invention.

It should be appreciated that rocking member 14 is preferably designed as an injection moulded part having a hollow central portion 22 and hollow end portions 24, as shown in FIG. 7.

Figure 9:
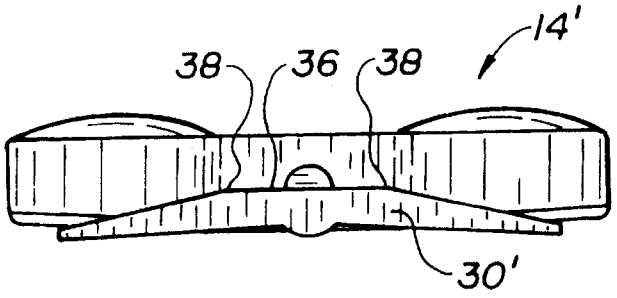
FIG. 9 is a side plan view of the rocking member according to another preferred embodiment of the present invention.
Figure 10:
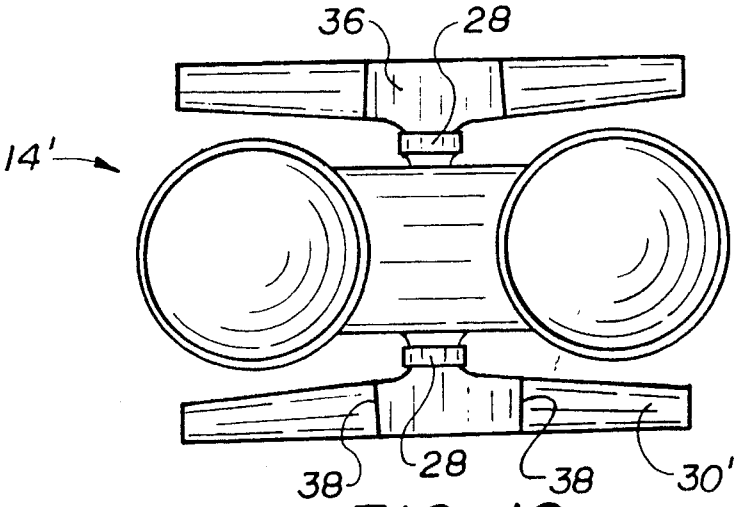
FIG. 10 is a top plan view of the rocking member according to the preferred embodiment shown in FIG. 9.

Referring now to FIGS. 9 and 10, there is shown another preferred embodiment of the present invention. This embodiment includes a rocking member or AFD 14' which is the same as the first embodiment in all respects except for the design of support arms 30'. In the area of rods 28, support arms 30' respectively have a flat bearing surface 36. Support arms 30' have bevelled surfaces extending from flat bearing surface 36 to the respective end sections of support arms 30'. Accordingly, two tilting edges 38 are formed on each support arm 30'. Flat bearing surfaces 36 of support arms 30' cooperate with respectively provided bearing surfaces or areas formed in base plate 12. Accordingly, flat bearing surfaces 36 abut against the respective bearing surfaces formed in base plate 12. As in the first preferred embodiment, bearing surfaces in the form of abutment or contact bars 20 are provided in base plate 12 for contacting respective end sections of support arms 30'.

In this embodiment of the present invention, a predetermined pivoting movement of rocking member 14' begins only after the ski boot has been laterally displaced by a predetermined amount. The amount of displacement, after which a respective pivoting of rocking member 14' is carried out, can be set so that it corresponds to the release of the ski boot from the sole holder or the lateral jaws of the ski binding.

The foregoing description is for specific embodiments of the invention. It should be appreciated that these embodiments are described for purposes of illustration only and that numerous alterations and modifications may be practiced by those skilled in the art without departing from the spirit and scope of the invention. It is intended that all such modifications and alterations be included insofar as they come within the scope of the invention as claimed or the equivalents thereof.

The invention claimed is:

1. A ski binding comprising:

base plate means having upper and lower surfaces for supporting a ski boot, said base plate means having a recess means formed therein;

sole holder means mounted to said base plate means for receiving the sole of a ski boot; and an anti-friction means for controlling the friction between the ski boot sole and the sole holder means during a lateral release of the ski boot from the sole holder, said anti-friction means comprising:

a rocking member pivotally supported in the base plate for rocking movement about a fixed longitudinal axis of the ski binding relative to said base plate and cooperating with said recess means, said rocking member having at least one transversely disposed end portion along each side of said longitudinal axis, said end portions having at least one upwardly extending protrusion depressingly engageable with said ski boot sole to rock said rocking member to reduce friction between the ski boot sole and the sole holder.

2. A ski binding as defined in claim 1, wherein each end portion of said rocking member has an upwardly extending protrusion.

3. A ski binding as defined in claim 2, wherein said rocking member is further comprised of:

a central portion;

said transversely disposed end portions extending from opposite ends of the central portion, each said end portion supporting one of said protrusions;

at least one support arm means arranged laterally and parallel to the central portion, and having an upper surface and oppositely disposed support arm ends; and connecting means for connecting the at least one support arm means with the central portion;

said support arm means configured to rock said rocking member when the ski boot sole moves one of said protrusions relative to the base plate.

4. A ski binding as defined in claim 3, wherein said rocking member comprises two support arms, each said support arm arranged on forward and rearward sides of said central portion.

5. A ski binding as defined in claim 3, wherein the lower surface of said base plate means includes recesses for operatively receiving said connecting means.

6. A ski binding as defined in claim 3, wherein the upper surface(s) of said support arm means are bevelled from the portion(s) of the support arm means proximate said central portion towards the respective support arm ends.

7. A ski binding as defined in claim 6, wherein the base plate means has bearing surfaces, said bearing surfaces cooperating with the bevelled upper surface of said support arm means when a higher load is applied to one protrusion than to the other protrusion, causing the rocking means to pivot in a predetermined manner.

8. A ski binding as defined in claim 3, wherein the upper surface of the support arm means has a flat bearing surface at the center thereof, and a bevelled surface extending from the flat bearing surface to each support arm end.

9. A ski binding as defined in claim 8, wherein the base plate means has bearing surfaces, said bearing surfaces cooperating with the upper surface of the support arm means when a ski boot is laterally displaced a predetermined amount and a higher load is applied to one of the protrusions extending through the recess than to the other protrusion.

10. A ski binding as defined in claim 3, wherein said support arm means further comprises one support arm, said support arm providing freedom of movement of said rocking member in the longitudinal axis of the base plate.

* * * * *

UNITED STATES PATENT AND TRADEMARK OFFICE

CERTIFICATE OF CORRECTION

PATENT NO. : 5,511,816

DATED : April 30, 1996

INVENTOR(S) : Gerhard Sedlmair

It is certified that error appears in the above-indentified patent and that said Letters Patent is hereby corrected as shown below:

On title page, insert the following, "Foreign Application Priority Data" — [30] Jan. 12, 1994 [DE] Germany.....9400446[U]—

Signed and Sealed this

Tenth Day of September, 1996

*Attest:*

Bruce Lehman

BRUCE LEHMAN

*Attesting Officer*

*Commissioner of Patents and Trademarks*